US007000619B2

(12) United States Patent
Winckels et al.

(10) Patent No.: US 7,000,619 B2
(45) Date of Patent: Feb. 21, 2006

(54) SYSTEM AND METHOD FOR APPLYING HAIR PRODUCT TO HAIR STRANDS

(75) Inventors: Mathilde Winckels, Clichy (FR); Luc Gourlaouen, Ashieres (FR)

(73) Assignee: L'Oreal S.A., Paris (FR)

( * ) Notice: Subject to any disclaimer, the term of this patent is extended or adjusted under 35 U.S.C. 154(b) by 9 days.

(21) Appl. No.: 10/459,567

(22) Filed: Jun. 12, 2003

(65) Prior Publication Data

US 2004/0031502 A1 Feb. 19, 2004

Related U.S. Application Data

(60) Provisional application No. 60/390,110, filed on Jun. 21, 2002.

(30) Foreign Application Priority Data

Jun. 13, 2002 (FR) ..... 02 07285

(51) Int. Cl.
*A61K 7/13* (2006.01)
*A45D 19/18* (2006.01)

(52) U.S. Cl. ..... 132/208; 132/270

(58) Field of Classification Search ..... 132/207, 132/222, 208, 108, 112, 270; 401/153, 156, 401/195

See application file for complete search history.

(56) References Cited

U.S. PATENT DOCUMENTS 2,655,924 A 10/1953 Petitta
3,012,695 A 12/1961 Lemer
3,137,305 A * 6/1964 Jones ..... 401/28
3,255,765 A 6/1966 Sturdivant
3,295,535 A 1/1967 Amato
3,452,759 A * 7/1969 Sarinelli ..... 132/270
3,610,257 A * 10/1971 Hall ..... 132/270
4,961,439 A 10/1990 Hartmann
5,067,501 A 11/1991 Auger
5,584,309 A * 12/1996 De Beneditis et al. ..... 132/208
5,676,480 A 10/1997 Tosto
5,755,241 A * 5/1998 Cheung ..... 132/112
5,771,906 A * 6/1998 De Benedictis ..... 132/207
6,035,862 A * 3/2000 Di Luca ..... 132/270
6,295,993 B1 10/2001 Ouellette
6,568,404 B1 * 5/2003 Mitchem ..... 132/112

(Continued)

FOREIGN PATENT DOCUMENTS

WO WO 92/14379 9/1992

(Continued)

*Primary Examiner*—Todd E. Manahan
(74) *Attorney, Agent, or Firm*—Finnegan, Henderson, Farabow, Garrett & Dunner, LLP

(57) ABSTRACT

A system for applying a hair product to hair strands may include an applicator including a reservoir forming portion for containing a hair product to be applied. The applicator may include an applicator portion that may include an application area configured to engage with at least one hair strand during relative movement, in a direction longitudinal to the at least one hair strand, of the applicator with respect to the at least one hair strand. The applicator may include at least one passage configured to transfer hair product between the reservoir forming portion and the application area during the relative movement of the applicator. The system may include a flexible sleeve configured to receive the at least one hair strand via one of the open ends and to enclose the at least one hair strand over at least a portion of the length of the at least one hair strand.

10 Claims, 6 Drawing Sheets

U.S. PATENT DOCUMENTS

| | | | | |
|---|---|---|---|---|
| 6,626,599 | B1 * | 9/2003 | De Laforcade | 401/10 |
| 6,647,989 | B1 * | 11/2003 | De Benedictis | 132/210 |
| 6,748,957 | B1 * | 6/2004 | Giordano | 132/112 |

FOREIGN PATENT DOCUMENTS

| | | |
|---|---|---|
| WO | WO 93/05677 | 4/1993 |

* cited by examiner

SYSTEM AND METHOD FOR APPLYING HAIR PRODUCT TO HAIR STRANDS

This application claims the benefit of priority under 35 U.S.C. § 119(e) of U.S. provisional application No. 60/390,110, filed Jun. 21, 2002.

The present invention relates to a system and method for applying product to strands, for example, for applying hair products, such as coloring and/or bleaching products, to hair strands.

In the field of systems for applying a product to strands, various techniques are used for applying hair products in a strand by strand manner.

According to a first method, a perforated cap is placed on the head of a consumer. By means of a tool, one end of which is configured in the form of a hook, the strands opposite the perforations may be extracted from under the cap. The product may then be applied on these strands, for example, by means of a brush. After a suitable exposure time, the cap may be removed. The action of the coloring product may then be neutralized with shampoo. Such a method is described, for example, in U.S. Pat. No. 4,961,439. There may be numerous drawbacks associated with the aforementioned method. For example, it may be painful for the consumer when the strands are extracted from the cap and when the cap is removed from the head. Further, it may take a relatively long time and it may be relatively tedious to implement the method. In addition, there may be a relatively great risk that the product might leak through the holes in the cap and stain the scalp.

According to another method, a strand may be placed on a palette, and the product may be applied to the strand using a brush. The strands may be exposed to the open air and separated from the rest of the hair by cotton placed at the root of the hair. After an appropriate exposure time, the hair may be washed in a conventional manner. This method may be lengthy and tedious. In addition, the treated strands may inevitably come into contact with at least a portion of the rest of the hair, which may, to a great extent, compromise the aesthetic appearance of the resulting treatment.

According to yet another method, after applying the product to a strand, the strand may be wrapped up using a sheet of aluminium paper so as to isolate it from the rest of the hair. Noise generated by the positioning of the sheet of aluminium may be particularly unpleasant for the consumer. Further, this method may be tedious and give rise to a significant difference in exposure time between the first strand and the last strand exposed to the product.

In the methods previously described herein, the quantity of product deposited on the strand may depend to a large extent on the volume of the strand treated. Because of this, the degree of exposure of a strand to the product may sometimes prove quite insufficient.

Other systems and or methods for applying hair product to hair strands are disclosed in U.S. Pat. Nos. 2,655,924 and 3,295,535, and in international application WO 92/14379. None of these methods has been particularly viable from a commercial perspective, perhaps because of their complexity of implementation and their unrealistic character.

One subject of the invention relates to providing a system for applying hair product to hair strands that may not have one or more of the aforementioned problems. For example, one subject of the invention may relate providing a system for applying hair product to hair strands which may substantially improve the degree of impregnation of the strands. Another subject of the invention may relate to providing a system which may afford relatively easy application of hair product without discomfort for the consumer. Yet another subject of the invention may relate to providing a system which may afford substantially even impregnation of the hair strands selected, without substantially affecting adjoining strands. Still another subject of the invention may relate to providing a system that may limit the risk of soiling fingers during use. A further subject of the invention relates to providing a system which may substantially reduce the risks of causing stains on the scalp.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should also be understood that these aspects and embodiments are merely exemplary. In one aspect, as embodied and broadly described herein, the invention includes a system for applying a hair product to hair strands. The system may include an applicator including a reservoir forming portion for containing a hair product to be applied. The applicator may include an applicator portion configured to apply hair product to hair strands. The applicator portion may include an application area configured to engage with at least one hair strand during relative movement, in a direction longitudinal to the at least one hair strand, of the applicator with respect to the at least one hair strand. The at least one hair strand may be at least one strand previously isolated from other strands. The applicator may include at least one passage configured to transfer hair product between the reservoir forming portion and the application area during the relative movement of the applicator so as to substantially coat the at least one hair strand with hair product. The system may include a flexible sleeve including two open ends, and the sleeve may be configured to receive the at least one hair strand via one of the open ends and to enclose the at least one hair strand over at least a portion of the length of the at least one hair strand.

For example, a strand may be exposed to the product substantially simultaneously with the movement of the applicator relative to the strand. The flexible sleeve may be gradually unrolled (e.g., like a tube) along the already exposed strand, and may substantially prevent any contamination of adjoining strands by the exposed strand, which has just been treated. The method may be relatively simple to implement and may require substantially less time than conventional methods. Further, in the case of, for example, a coloring product that contains ammonia, any malodorous emanations thereof may be limited. In addition, by varying the configuration of the application area (e.g., its dimensions), it may be possible to treat particularly fine strands, which may render it possible to obtain aesthetic effects that may be difficult to achieve with conventional techniques.

According to another aspect, the flexible sleeve may be configured to be associated with the applicator so as to be placed around the at least one strand substantially simultaneously with at least a part of the relative movement of the applicator.

By enclosing the strand simultaneously, or substantially simultaneously, with it being placed in contact with the product, the quantity of product with which the strand may be loaded may be increased, and the resulting color may be improved, and the exposure time may be reduced. The amount of time necessary for implementing the method may also be reduced. Further, the risk of contamination of the untreated strands by the treated strands may also be reduced.

The product retaining area may be fed in response, for example, to a reduction in volume of the reservoir forming portion. According to still another aspect, the reservoir forming portion may define a volume configured to be varied, and the system may be configured to supply hair product to the application area in response to reducing the volume of the reservoir forming portion. In yet another aspect, the reservoir forming portion may include at least one elastically deformable wall, wherein the volume of the reservoir forming portion may be configured to be reduced via pressure exerted on the elastically deformable wall. For example, the at least one elastically deformable wall may include a bellows.

In some exemplary embodiments having the body of the reservoir forming portion configured in the form of a bellows over at least part of its length, the pressure able to cause a discharge of the product and its routing to the application area may be a pressure exerted in a direction substantially along the longitudinal axis of the applicator. In another aspect, a reduction in volume may result from a pressure exerted on elastically deformable walls of the reservoir forming portion, and the pressure exerted may be in a direction substantially perpendicular to the longitudinal axis of the applicator.

The reservoir forming portion may be substantially filled using elastic deformability of the reservoir. For example, after having compressed the reservoir via exerting a sufficient amount of pressure, the applicator may be substantially soaked in a bowl containing the product to be applied so that an orifice via which the applicator portion may be fed is immersed in the product. The pressure exerted on the walls of the reservoir forming portion, which may return by elastic force to their substantially undeformed configuration, may then be released. A negative pressure may be created inside the reservoir forming portion, which may cause the product to be drawn into the reservoir forming portion. In another aspect, it may be possible to provide a distinct orifice for filling the reservoir forming portion through which the product may enter (e.g., via pouring). The orifice may then be closed off, for example, by a removable plug that may be fixed in the orifice (e.g., via at least one of threading, snap fastening, welding, and bonding).

According to yet another aspect, the applicator may have a single piece construction. For example, the single piece construction may be formed via extrusion blow molding. The material of the single piece construction may include, for example, a polyolefin (e.g., of the polyethylene type).

In still another aspect, the applicator portion may include a portion attached and fixed to the reservoir forming portion via at least one of snap fastening, threading, adhesive bonding, clamping, and welding. For example, the reservoir forming portion may be formed by extrusion blow molding. Such an applicator may be configured for single use and/or configured so as to be able to be cleaned for subsequent uses.

According to a further aspect, the applicator may define an elongate shape and the flexible sleeve may be configured to slide onto the applicator via the applicator portion of the applicator. In this position, the flexible sleeve may be axially compressed and the first end of the flexible sleeve may able to be in axial abutment against a suitable portion of the applicator with the second end being situated somewhere between the first end and the applicator portion, for example, so as not to interfere with the engagement of the strand with the applicator portion.

The flexible sleeve may be removably mounted around the applicator, and once fitted around the strand, the strand having been substantially coated, the flexible sleeve may be disengaged from the applicator portion and the flexible sleeve may be disengaged from the applicator, for example, in order to remain around the strand. Another axially compressed sleeve (e.g., a new flexible sleeve) may then be mounted around the applicator so as to be placed around another strand to be coated by the applicator.

In another aspect, at least one open end of the flexible sleeve may be configured to substantially ensure at least partial and reversible closure of the at least one open end (e.g., the at least one end may include deformable means for reversibly ensuring at least partial closure of the at least one end). For example, the at least one open end may include a free edge, and the at least one open end may be configured to keep the free edge substantially in contact with itself. For example, the at least one open end may be configured to clamp the free edge on itself. In a further aspect, each of the two open ends may be configured to substantially ensure at least partial and reversible closure of itself.

The product may be substantially prevented from flowing onto the scalp and may be substantially prevented from flowing onto the shoulders of the consumer via the other end of the flexible sleeve. The degree of closure of the ends of the flexible sleeve may depend on the viscosity of the composition to be applied.

According to a further aspect, the at least one open end may include a spring structure configured to restrain a free edge of the at least one open end such that the free edge clamps onto itself. Similar reversible closures, for example, may be found on some spectacle cases.

In yet another aspect, the at least one open end may include a flexible material having a relatively weak shape memory. For example, the flexible material may include a sheet including at least one of an aluminum based material and a material based on a complex of aluminum and plastic. The closure may be formed, for example, in the form of a reinforcing ring situated at each end.

According to a further aspect, the flexible sleeve may be formed from one of a transparent material and a translucent material. In still another aspect, the flexible sleeve may be formed via one of extrusion, at least one of welding and bonding two sheets to one another along two longitudinal edges, and folding a sheet on itself and at least one of welding and bonding two longitudinal edges to one another.

In yet another aspect, the system may include a hair product contained in the reservoir forming portion. For example, the hair product may include at least one of a cosmetic product and a care product (e.g., the hair product may include at least one of a bleach product and a coloring product).

According to yet a further aspect, a method for applying a hair product to hair strands may include engaging an application area of an application portion of an applicator with at least one strand of hair. The application area may be supplied with hair product via at least one passage configured to communicate with a reservoir containing the hair product. The method may include maintaining the engagement between the application area and the at least one hair strand while causing a relative movement of the applicator with respect to the at least one hair strand in a direction longitudinal to the at least one hair strand, so as to substantially coat the at least one hair strand with the hair product. The method may include substantially enclosing at least a portion of a length of the at least one hair strand with a flexible sleeve having two open ends while causing at least a portion of the relative movement of the applicator with respect to the at least one hair strand.

In a further aspect, the application area may be engaged with the at least one hair strand at a point on the at least one hair strand situated in the vicinity of the scalp, and the relative movement of the applicator with respect to the at least one hair strand may occur in a direction toward of a free end of the at least one hair strand.

In yet another aspect, the method may include at least partially closing an open end of the flexible sleeve closest to the scalp, wherein the open end closest to the scalp may be closed on the at least one hair strand so as to limit flow of product in the direction of the scalp.

In still another aspect, the method may include disengaging the application area from the at least one hair strand, and, after disengagement, at least partially closing an open end of the flexible sleeve remote from the scalp so as to limit the flow of product through the open end of the flexible sleeve remote from the scalp.

According to a further aspect, the method may include working the at least one hair strand inside the flexible sleeve so as to improve the coating of the at least one hair strand with hair product.

According to yet another aspect, a device for enveloping the at least one hair strand having hair product applied thereto may include a flexible envelope having two open ends and an elongate shape. The flexible envelope may be configured to receive the at least one strand and at least one of the open ends may be configured to at least partially close the at least one open end on the at least one hair strand after at least partially inserting the at least one strand into the flexible envelope. In still another aspect, each of the two open ends may be configured to at least partially close itself on the at least one hair strand after inserting the at least one hair strand in the envelope. In yet another aspect, the at least one open end may include a ring formed of a flexible material having a relatively weak shape memory. For example, the ring may include at least one of aluminum and a spring structure.

In still a further aspect, a method for applying hair product to hair strands may include engaging, with at least one strand of hair, an orifice defined in an elongate portion of an applicator, wherein a flexible sleeve is placed on the elongate portion. The method may include applying hair product to the at least one hair strand via the orifice while sliding the at least one strand through the orifice. The method may include pulling the at least one strand at least partially into the flexible sleeve with the applicator. According to a further aspect, the method may include removing the elongate portion of the applicator from the flexible sleeve. In still another aspect, the method may include closing at least one end of the flexible sleeve onto the at least one strand. In yet a further aspect, the method may include closing a second end of the flexible sleeve.

According to an additional aspect, a system for applying a hair product to hair strands may include an applicator including a reservoir forming portion for containing a hair product, and an applicator portion configured to be in flow communication with the reservoir forming portion. The applicator portion may include an elongate member defining an orifice configured to engage and apply the hair product to at least one strand while moving the applicator with respect to the at least one hair strand so as to slide the at least one hair strand through the orifice. The system may include a flexible sleeve configured to be placed on the applicator portion of the applicator, and the sleeve may be configured to at least partially enclose the at least one hair strand and to retain hair product applied to the at least one hair strand.

According to yet another aspect, the flexible sleeve may be configured to be in a shortened configuration when the sleeve is placed on the applicator portion and in a lengthened configuration when the sleeve at least partially encloses the at least one hair strand. In yet another aspect, the orifice may include a slot.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic perspective view of an embodiment of an applicator for applying hair product to hair strands;

Reference will now be made in detail to some possible embodiments of the invention, examples of which are illustrated in the accompanying drawings. Wherever possible, the same reference numbers are used in the drawings and the description to refer to the same or like parts.

Figure 1:
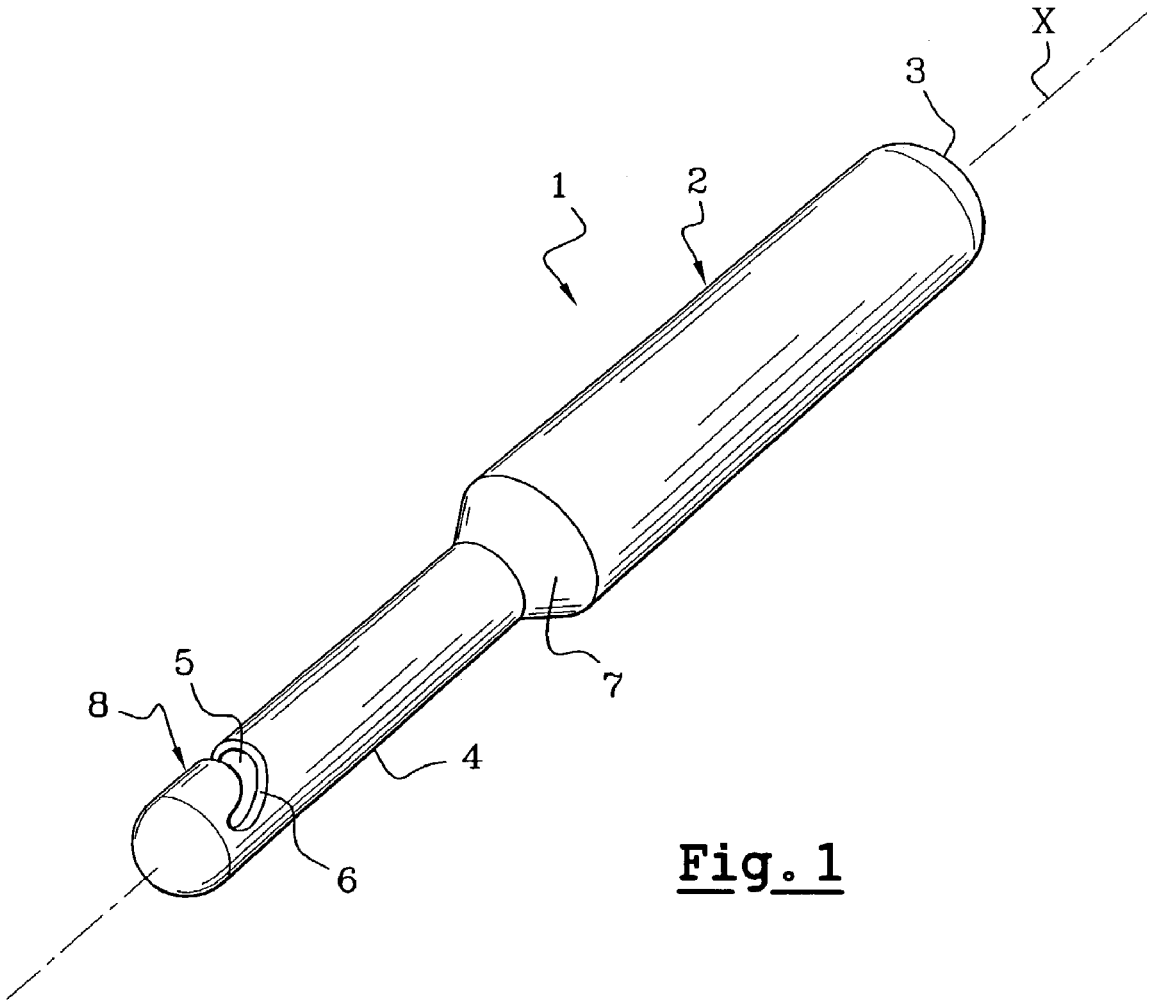
Figure 2:
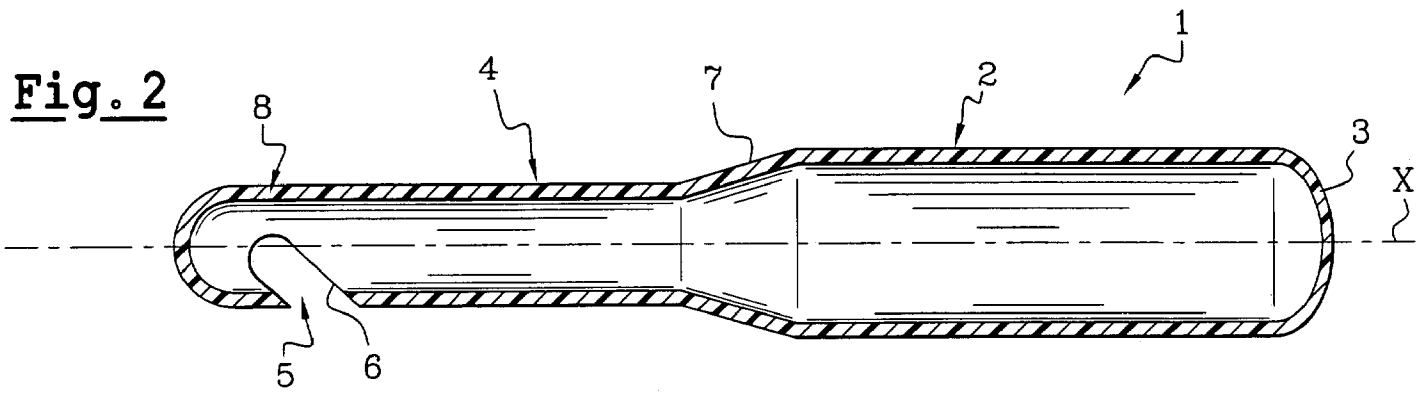
FIG. 2 is a schematic section view of the embodiment of the applicator of FIG. 1.

FIGS. 1 and 2 depict an exemplary embodiment of an applicator 1 that may have an elongate shape along an axis X. The applicator 1 may, for example, be produced via extrusion blow molding of a material such as, for example, a polypropylene and/or low-density polyethylene.

The applicator 1 may include a reservoir forming portion 2 that may define an end 3 and another end opposite to the end 3 that may be extended by a portion 4 having, for example, a smaller cross-section that may form a passage such that product may reach an applicator portion 8.

The applicator portion 8 may include an opening 5 (e.g., slot) provided in a wall (e.g., a side wall) of the portion 4 that may be in the vicinity of the end opposite to the end 3. An edge 6 defining the opening 5 may be configured to substantially form a hook that may include an application area. The reservoir forming portion 2 may be separated from the portion 4 by, for example, a shoulder 7.

The walls of the reservoir forming portion 2 may be elastically compressible so as to cause, for example, a reduction in the volume of the reservoir forming portion 2 and the conveying of the product in the direction of the applicator portion 8 (e.g., in response to a pressure exerted substantially perpendicular to the axis X). The volume of the reservoir forming portion 2 may be configured to contain the quantity of product necessary for treating one or more strands.

Figure 3:
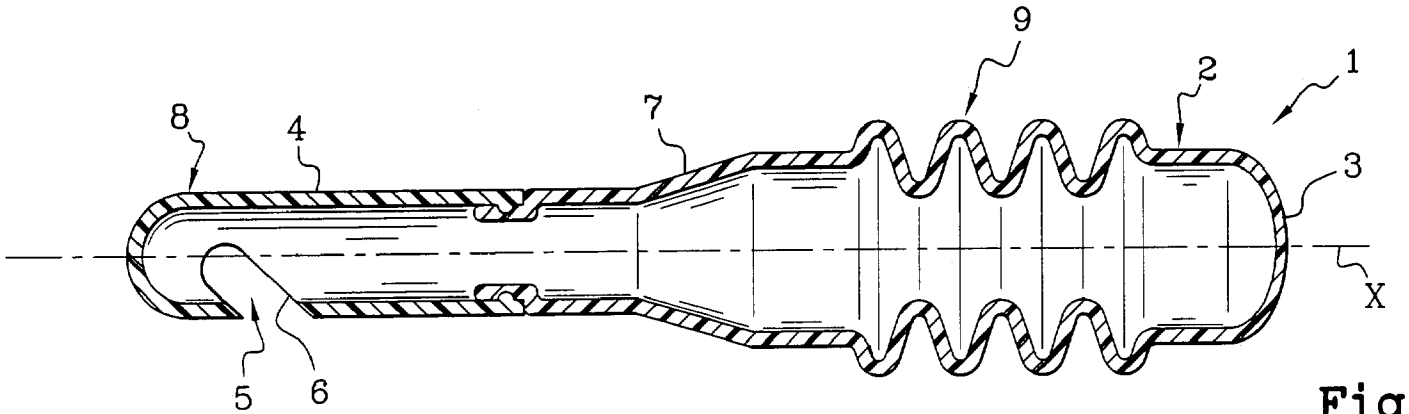
FIG. 3 is a schematic section view another embodiment of an applicator for applying hair product to hair strands.

FIG. 3 depicts an exemplary embodiment of an applicator 1 that may be configured, over a portion of the length of the body of the reservoir forming portion 2, in the form of a bellows 9 so that a pressure exerted axially on the end 3 of the reservoir forming portion 2 may cause a reduction in the volume of the reservoir forming portion 2, and may pressure the product causing the product's transfer toward the applicator portion 8. The applicator 1 may include an applicator portion 8 that may include a piece produced, for example, independently of the reservoir forming portion 2, and may be mounted on the reservoir forming portion 2 via, for example, snap fastening and/or any other suitable manner, such as, for example, threading, adhesive bonding, and/or welding.

Figure 4A:
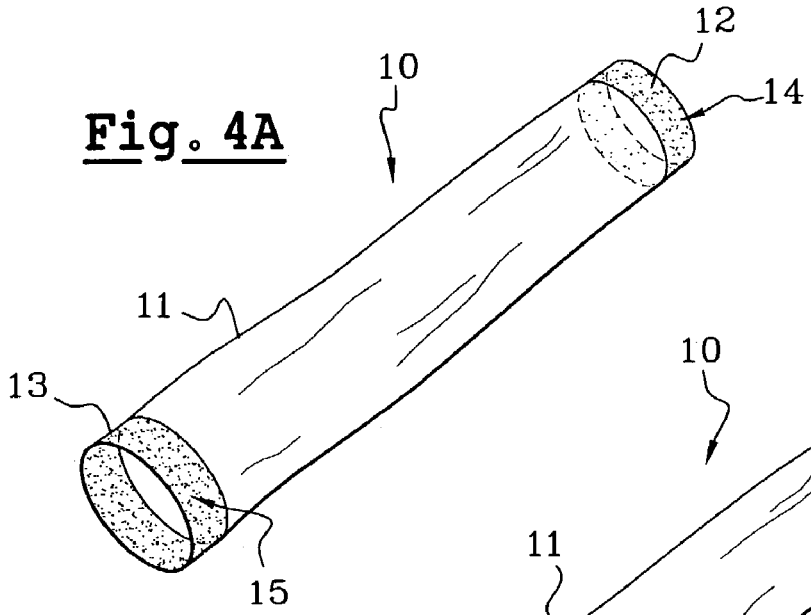
FIG. 4A is a schematic perspective view of an embodiment of a flexible sleeve.
Figure 4B:
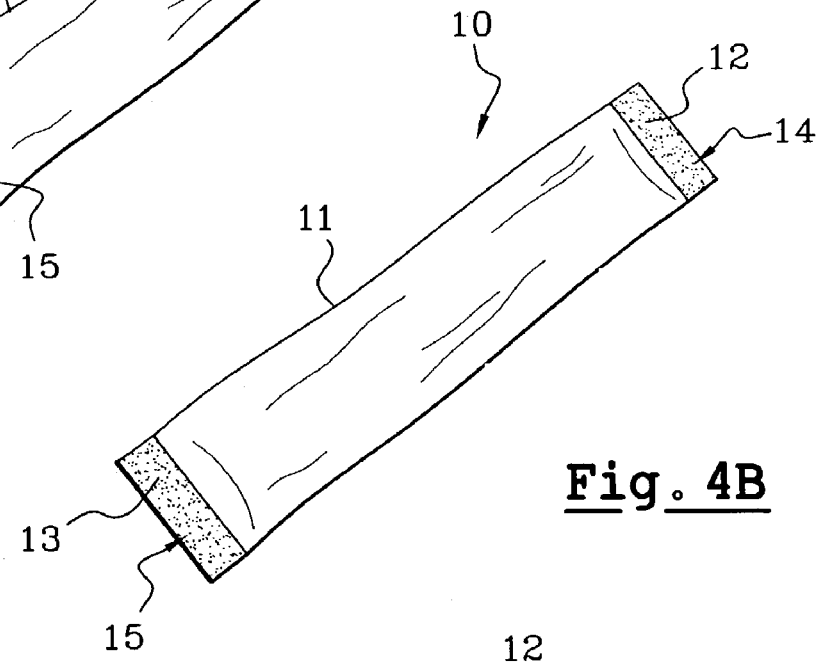
FIG. 4B is a schematic perspective view of the embodiment of the flexible sleeve of FIG. 4A in another configuration.

FIGS. 4A and 4B depict an exemplary embodiment of a flexible sleeve 10 for substantially enveloping a strand to which product may have been applied. The flexible sleeve 10 may define a substantially elongate envelope 11 (e.g., a flexible envelope) that may be open at both ends 12 and 13. The length of the flexible sleeve 10 may range, for example, from about 10 centimeters to about 40 centimeters, depending on, for example, the length of the strand for which it is intended to be used. The width of the flexible sleeve 10, perpendicular to its longitudinal axis, may range, for example, from about from 1 centimeter to about 5 centimeters, or from about 2 centimeters to about 4 centimeters. For producing fine strands, the width of the envelope 11 may range, for example, from about 1.5 centimeters to about 2 centimeters. For larger strands, the width of the envelope 11 may range, for example, from about 2.5 centimeters to about 3 centimeters.

The envelope 11 may be substantially tubular and may be formed, for example, by extrusion or by folding of a sheet (e.g., of polyethylene) around its longitudinal axis, and then by securing (e.g., welding and/or bonding) the two longitudinal edges of the sheet to each other. Alternatively, the envelope 11 may be formed by the superimposition of two substantially identical sheets welded and/or adhesively bonded to each other along their respective longitudinal edges.

Each of the ends 12 and 13 of the envelope 11 may be reinforced, for example, by means of a ring (e.g., annulus) 14 and 15, which may be produced from a deformable material having a relatively weak shape memory, for example, a material based on aluminium. The rings 14 and 15 may be arranged either inside or outside the envelope 11 and may be fixed to the envelope 11, for example, by adhesive bonding. The rings 14 and 15 may enable an edge delimiting the corresponding open end of the flexible sleeve 10 to tighten on itself, so as to at least partially close the flexible sleeve 10 when the rings 14 and 15 are crushed onto themselves. For example, FIG. 4B schematically depicts the ends 12 and 13 in an at least partially closed configuration.

Figure 5:
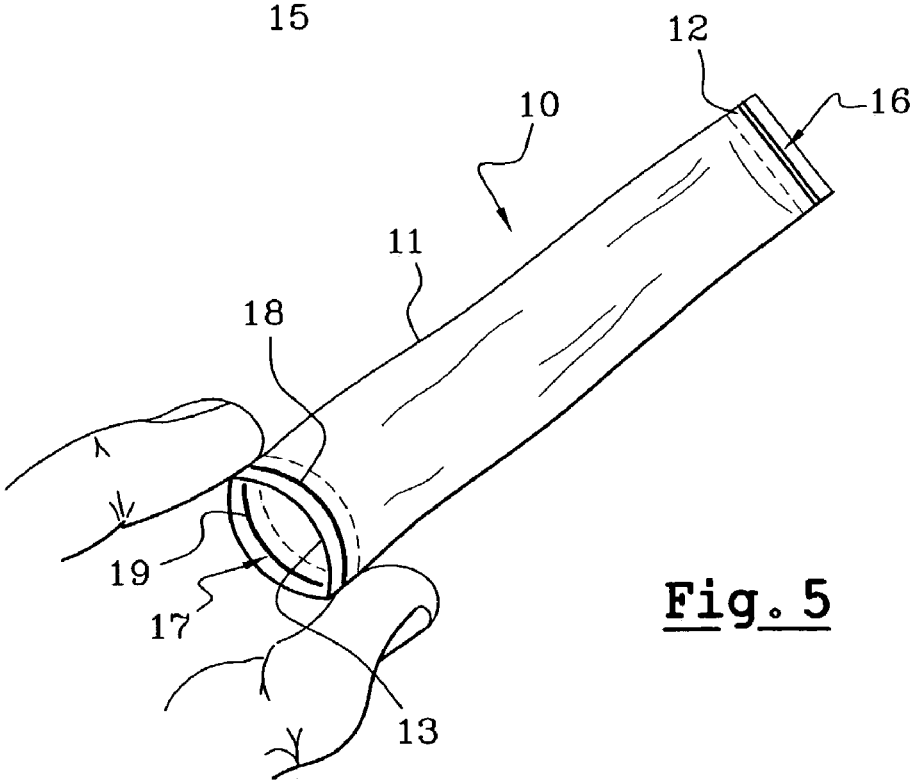
FIG. 5 is a schematic perspective view of another embodiment of a flexible sleeve.

FIG. 5 depicts an exemplary embodiment of an envelope 11 that may include closure devices 16 and 17 for its ends 12 and 13, respectively. The closure devices 16 and 17 may each form a spring that includes, for example, two substantially cylindrical elements 18 and 19, which may be connected to each other by their two respective ends. The closure devices 16 and 17 may be, for example, in the absence of any force, in contact with each other over substantially their entire length (e.g., the length of end 12). The end 12 of the envelope 11 may be substantially closed. When a pressure is exerted on the two ends of an arrangement such as the exemplary spring 17, the two elements 18 and 19 may move away from each other (with the exception of their ends), thus causing the corresponding end of the flexible sleeve 10 to open (as shown in FIG. 5, at end 13). When the pressure ceases, the elements 18 and 19 may be configured to substantially resume their contiguous position by, for example, elastic return. The elements forming springs 18 and 19 may be formed from metal and/or plastic.

FIGS. 6A through 6G schematically depict exemplary steps of an exemplary method of using an exemplary embodiment of a system for applying product to strands.

Figure 6A:
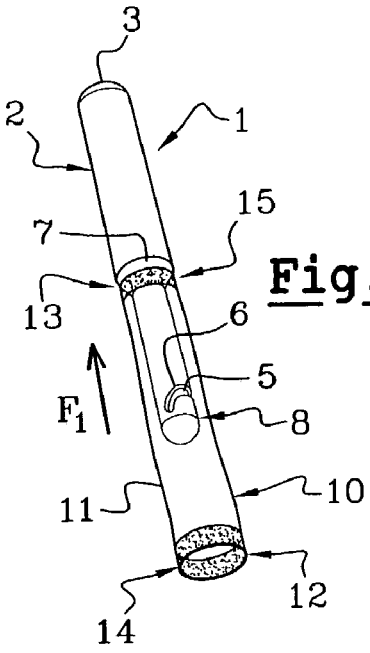
FIG. 6A is a schematic perspective view of one portion of an example of a method for applying hair product to hair strands.

FIG. 6A depicts a flexible sleeve 10 slipped onto an applicator 1 (e.g., much like a sock) over an applicator portion 8, via a movement, for example, depicted by the arrow $F_1$.

Figure 6B:
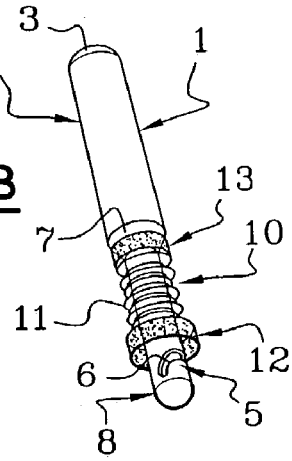
FIG. 6B is a schematic perspective view of another portion of an example of a method for applying hair product to hair strands.

FIG. 6B depicts one end 13 of a flexible sleeve 10 in abutment against a shoulder 7 of an applicator 1. The other end 12 of the flexible sleeve 10 may be located between the first end 13 and the free end of the applicator portion 8 of the applicator 1, with the applicator portion 8 extending outside the flexible sleeve 10.

Figure 6C:
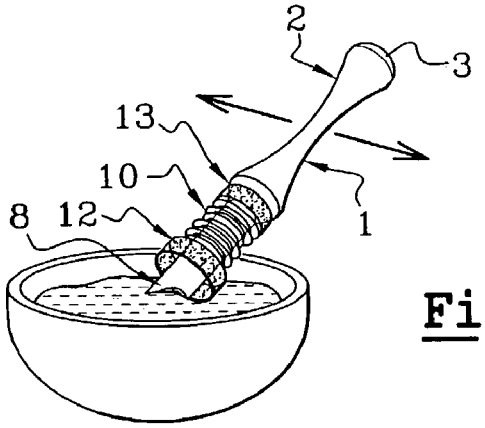
FIG. 6C is a schematic perspective view of a further portion of an example of a method for applying hair product to hair strands.

FIG. 6C depicts an applicator portion 8 immersed in, for example, a bowl containing the product to be applied. The walls of the reservoir forming portion 2 may be, for example, compressed prior to immersing the applicator portion 8 in the product. By releasing the pressure exerted on the walls of the reservoir forming portion 2, the walls may substantially resume their pre-compressed position (e.g., via elastic return). The product may enter the reservoir forming portion via the opening 5 in the applicator portion 8.

Figure 6D:
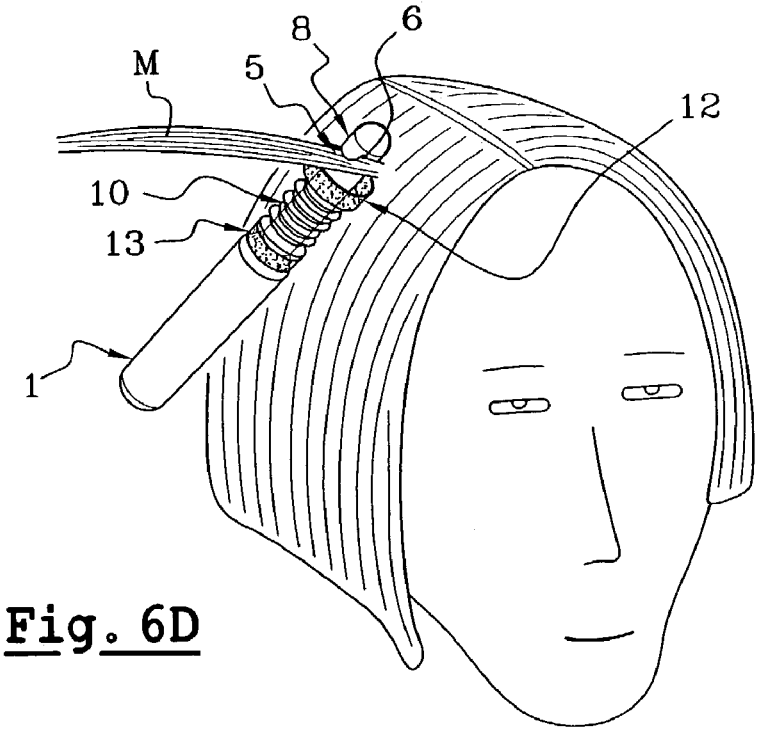
FIG. 6D is a schematic perspective view of another portion of an example of a method for applying hair product to hair strands.

FIG. 6D depicts an edge 6 of the opening 5 of the applicator 1 that has been engaged with strand M that has been taken from the hair, for example, as close as possible to the scalp. Prior to any relative movement between the applicator 1 and the strand M, and/or after a movement over a short distance, the user may lower the end 12 of the flexible sleeve 10 as close as possible to the scalp and press the annulus or ring 14 (e.g., metallic annulus or ring) onto the strand M, thus at least partially closing off the open end 12 of the flexible sleeve 10. For example, the strand M may not yet be completely arranged inside the flexible sleeve 10, and the end 12 may remain partially open, for example, to allow passage of the remainder of the strand M into the sleeve 10. After substantially complete introduction of the strand M into the sleeve 10, the opening 12 may be closed off.

Figure 6E:
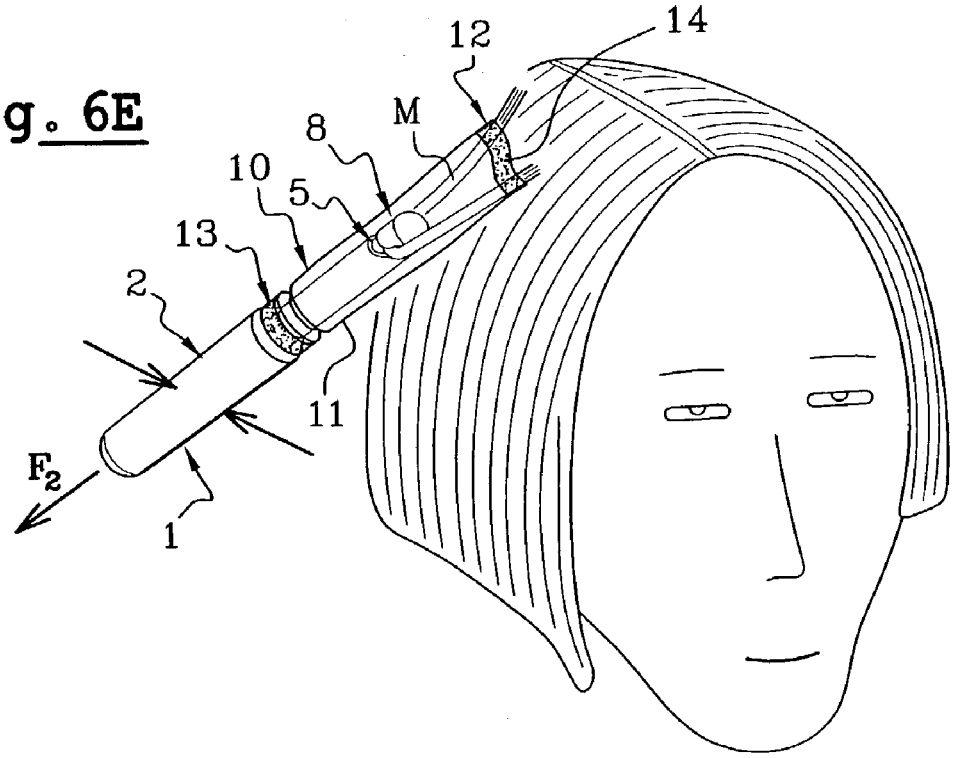
FIG. 6E is a schematic perspective view of a further portion of an example of a method for applying hair product to hair strands.

As depicted in FIG. 6E, while holding the ring 14 stationary relative to the strand M, the user may move the applicator 1 relative to the strand M in a direction toward the free end of the strand M (such as shown by the arrow $F_2$) while exerting pressure on the walls of the reservoir forming portion 2 so as to, in substantially simultaneous fashion with the movement of the applicator 1, substantially impregnate the strand M with the product (e.g., a coloring product).

Figure 6F:
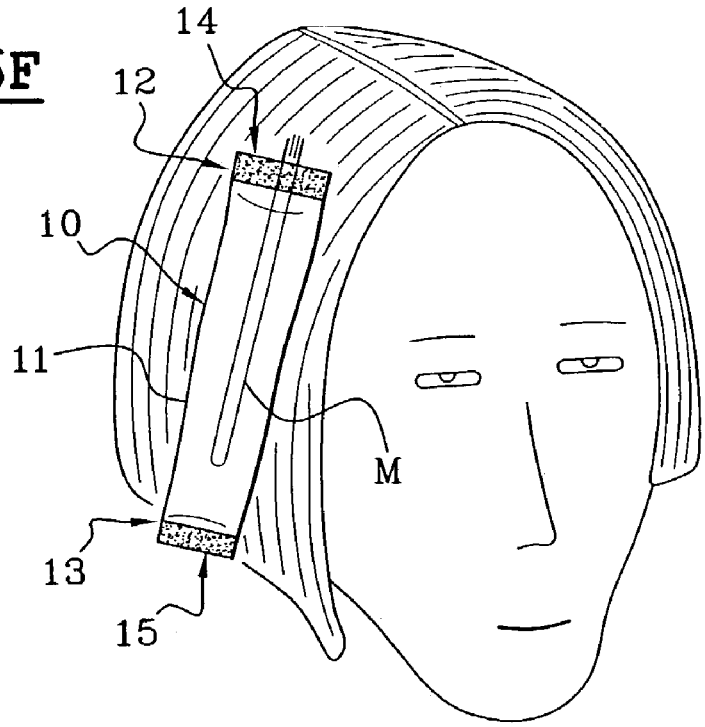
FIG. 6F is a schematic perspective view of another portion of an example of a method for applying hair product to hair strands.
Figure 6G:
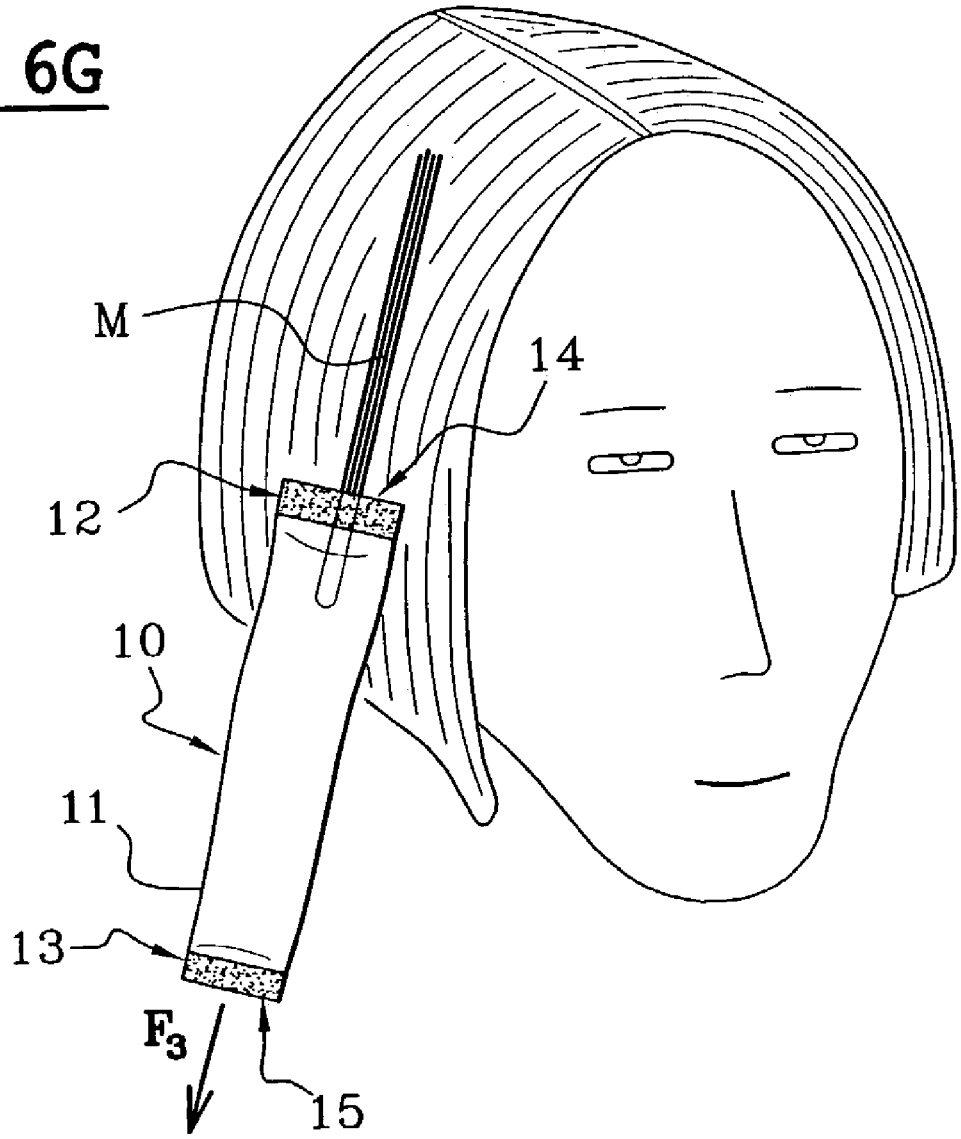
FIG. 6G is a schematic perspective view of a further portion of an example of a method for applying hair product to hair strands.

Substantially simultaneous with that movement, the flexible sleeve 10, one end of which (e.g., 12) may be fixed relative to the strand M and the other end of which (e.g., 13) may be held fixedly relative to the applicator 1, may be progressively deployed to substantially enclose the strand M over a substantial portion of its length as the strand M is gradually coated with the product. The movement may continue until, for example, when the applicator 1 arrives at the end of the strand M, the applicator 1 substantially disengages the strand M. As depicted in FIG. 6F, at this moment, for example, the user may press the ring 15 onto itself, thus substantially closing off the end 13 of the flexible sleeve 10.

Next, by using the fingers, for example, the user may work the strand M inside the flexible sleeve 10, thus positioned so as to complete the substantial impregnation of the strand M. The user may proceed in at least a similar manner with other strands to be treated.

As depicted in FIG. 6F, for example, after the required exposure time, the user may release the strand M from the protection of the flexible sleeve 10 by movement of the flexible sleeve 10 in the direction of the arrow $F_3$. The hair may then be rinsed in a conventional manner.

The application of hair product to hair strands may be completely painless for the subject whose strands have been treated, and the quantity of product deposited may not depend solely on the size of the strand, but may depend on, for example, the size of the tube inside which the strand is substantially enveloped as it is gradually exposed to the product. This may result in a substantially improved degree of impregnation of the strand. As a result, the exposure time may be appreciably reduced. Finally, other disadvantages peculiar to the methods discussed previously herein may have been drastically minimized or substantially eliminated.

The device according to some exemplary embodiments of the invention may be used to apply cosmetic products and/or care products, such as make-up products, dermatological substances, and/or pharmaceutical compositions used for treating and/or changing the appearance and/or scent of keratinous fibers, such as the hair. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A method for applying a hair product to hair strands, the method comprising:

engaging an application area of an application portion of an applicator with at least one strand of hair, the application area being supplied with hair product via at least one passage configured to communicate with a reservoir containing the hair product;

maintaining the engagement between the application area and the at least one hair strand while causing a relative movement of the applicator with respect to the at least one hair strand in a direction longitudinal to the at least one hair strand, so as to substantially coat the at least one hair strand with the hair product; and substantially enclosing at least a portion of a length of the at least one hair strand with a flexible sleeve having two open ends while causing at least a portion of the relative movement of the applicator with respect to the at least one hair strand.

2. The method of claim 1, wherein the application area is engaged with the at least one hair strand at a point on the at least one hair strand situated in the vicinity of the scalp, and wherein the relative movement of the applicator with respect to the at least one hair strand occurs in a direction toward of a free end of the at least one hair strand.

3. The method of claim 1, further comprising at least partially closing an open end of the flexible sleeve closest to the scalp, wherein the open end closest to the scalp is closed on the at least one hair strand so as to limit flow of product in the direction of the scalp.

4. The method of claim 1, further comprising disengaging the application area from the at least one hair strand, and, after disengagement, at least partially closing an open end of the flexible sleeve remote from the scalp so as to limit the flow of product through the open end of the flexible sleeve remote from the scalp.

5. The method of claim 1, further comprising working the at least one hair strand inside the flexible sleeve so as to improve the coating of the at least one hair strand with hair product.

6. The method of claim 1, wherein the hair product comprises at least one of a coloring product and a bleaching product.

7. A method for applying hair product to hair strands, the method comprising:

engaging, with at least one strand of hair, an orifice defined in an elongate portion of an applicator, wherein a flexible sleeve is placed on the elongate portion;

applying hair product to the at least one hair strand via the orifice while sliding the at least one strand through the orifice; and pulling the at least one strand at least partially into the flexible sleeve with the applicator.

8. The method of claim 7, further comprising removing the elongate portion of the applicator from the flexible sleeve.

9. The method of claim 8, further comprising closing at least one end of the flexible sleeve onto the at least one strand.

10. The method of claim 9, further comprising closing a second end of the flexible sleeve.

* * * * *